US006186295B1

(12) United States Patent
Lin et al.

(10) Patent No.: US 6,186,295 B1
(45) Date of Patent: Feb. 13, 2001

(54) WHEELED LUGGAGE WITH HIDDEN HANDLE ASSEMBLY

(75) Inventors: Jer Hong Lin, Taipei; Chung-Hsien Kuo, Pan-Chiao, both of (TW)

(73) Assignee: Chaw Khong Technology Co., Ltd., Taipei County (TW)

( * ) Notice: Under 35 U.S.C. 154(b), the term of this patent shall be extended for 0 days.

(21) Appl. No.: 09/391,612

(22) Filed: Sep. 7, 1999

(30) Foreign Application Priority Data

May 28, 1999 (TW) ..... 88208665

(51) Int. Cl.[7] ..... A45C 5/14; A45C 13/26

(52) U.S. Cl. ..... 190/18 A; 190/39; 190/115; 190/127; 280/37

(58) Field of Search ..... 190/18 A, 115, 190/122, 127; 280/37, 655.1; 16/115

(56) References Cited

U.S. PATENT DOCUMENTS 5,482,147 * 1/1996 Wang ..... 190/18 A X
5,533,603 * 7/1996 Wang ..... 190/115
5,566,798 * 10/1996 Tsai ..... 190/122 X
5,588,512 * 12/1996 Lin ..... 190/127 X
5,645,146 * 7/1997 Bieber et al. ..... 190/127 X
5,685,402 * 11/1997 Lin ..... 190/127 X

* cited by examiner

*Primary Examiner*—Sue A. Weaver
(74) *Attorney, Agent, or Firm*—Dougherty & Troxell

(57) ABSTRACT

A wheeled luggage comprises a body; a pair of wheels; a frame member; a backing plate; a retractable handle; and a bezel; wherein a plurality of first fasteners are employed to secure the backing plate to the bezel; a plurality of second fasteners are employed to secure the frame member to the backing plate; the body is secured to the frame member to form a complete structure; a first concave area is formed between the backing plate and the bezel; and a second concave area is formed between the first concave area and the concave portion of the backing plate for accommodating a users fingers. With this structure, the purposes of saving corrugated plastics and facilitating the user to grasp the handle are realized.

3 Claims, 7 Drawing Sheets

WHEELED LUGGAGE WITH HIDDEN HANDLE ASSEMBLY

BACKGROUND OF THE INVENTION

1. Field of the Invention

The present invention relates to a wheeled luggage in which handle assembly is hidden by top shell in a stored position, and backing plate, handle assembly, and frame member are secured together for enhancing structural strength which results in the decrease of corrugated plastics used, thereby decreasing the weight of the luggage case. Further, backing plate may be sized to accommodate different luggage capacities.

2. Description of Prior Art

Typically, force exerted on the handle grip by a user is uniformly distributed to the top and the bottom of luggage case through the bezel. Attention is invited to FIG. 1 for explaining the structure of a prior art luggage case. It is known that the handle assembly 61 is affixed to frame body 60 together with bezel 612 to form the main components for supporting luggage. Also known that top portion 62, side portions 62A and 62C, and bottom portion 62B are made of durable fracture resistant corrugated plastics. It is anticipated that the larger the frame body 60 the more the corrugated plastics needed. It is also known that the corrugated plastics only serves as providing structural support to the frame body 60. Further, the more corrugated plastics the more difficult in assembling a luggage.

As such, a need remains for decreasing the quantity of corrugated plastics used in the luggage resulting in the decrease in weight, while without compromising the structural strength. Further, the size of a concave grip area 613 is small after assembled in the top 62. In other words, the grip area 613 does not accommodate user's fingers, thus increasing the effort required to lift the case in a horizontal position, as into an automobile trunk or the like. Furthermore, plastics is not recyclable, thus the less the better in order to gain more support from consumers.

SUMMARY OF THE INVENTION

It is therefore an object of the present invention to provide a wheeled luggage in which the backing plate is affixed to the handle assembly and the frame member for enhancing structural strength which results in the decrease of corrugated plastics used, thereby decreasing the weight of the luggage case.

It is another object of the present invention to provide a wheeled luggage in which the backing plate may be sized to accommodate different luggage capacities for saving material.

It is still another object of the present invention to provide a wheeled luggage in which the bezel has a first concave portion and the backing plate has a second concave portion corresponding to the first concave portion for forming a concave area when the bezel and the backing plate are affixed together for accommodating user's fingers to grasp.

It is still another object of the present invention to provide a wheeled luggage in which the handle assembly is hidden by top shell in a stored position for preserving luggage's appearance.

The above and other objects, features and advantages of the present invention will become apparent from the following detailed description taken with the accompanying drawings.

DETAILED DESCRIPTION OF PREFERRED EMBODIMENTS

Figure 1:
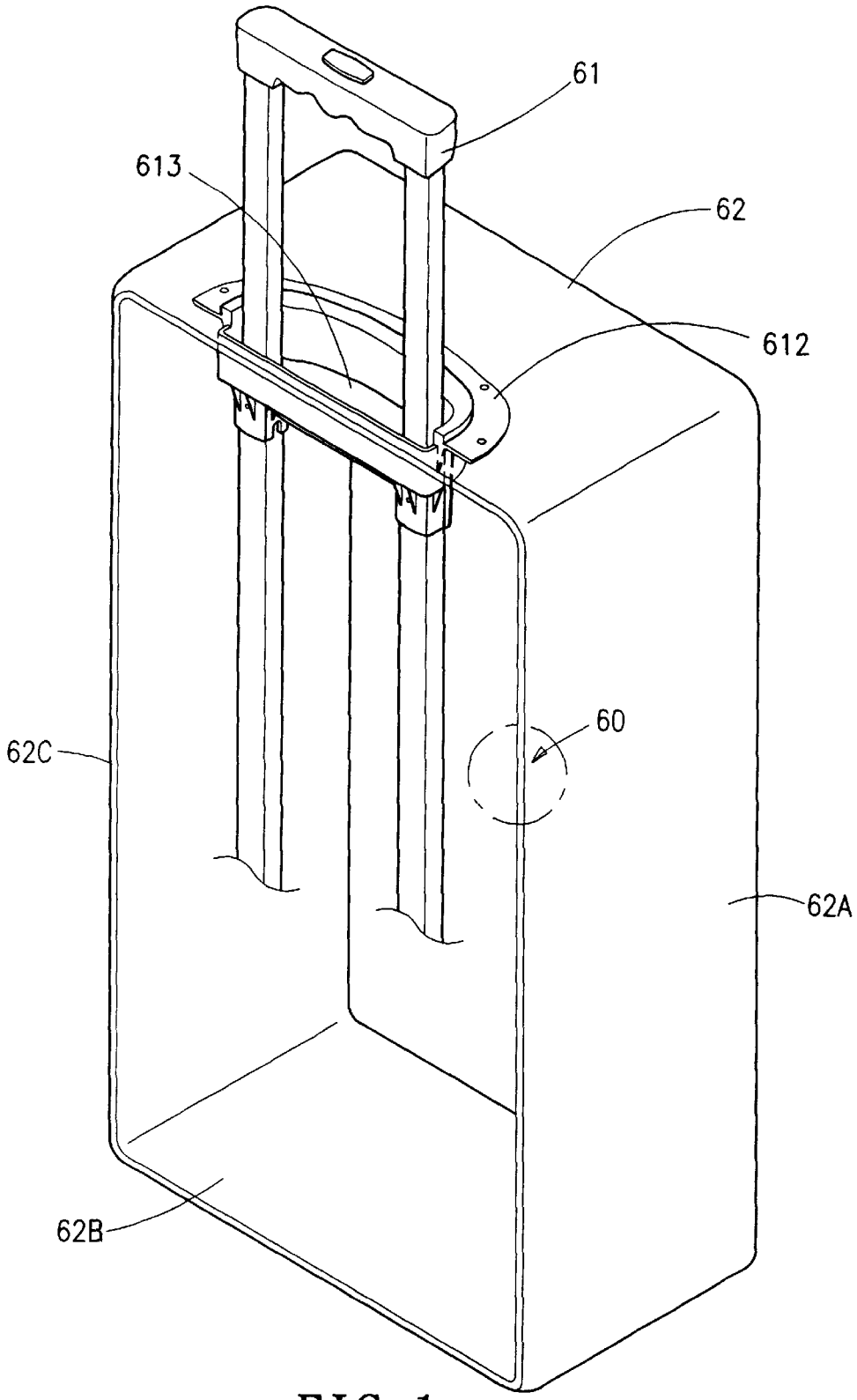
FIG. 1 PRIOR ART
FIG. 1 is a perspective view of a prior art wheeled luggage with retractable handle assembly.
Figure 1A:
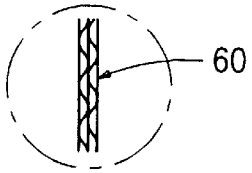
Figure 2:
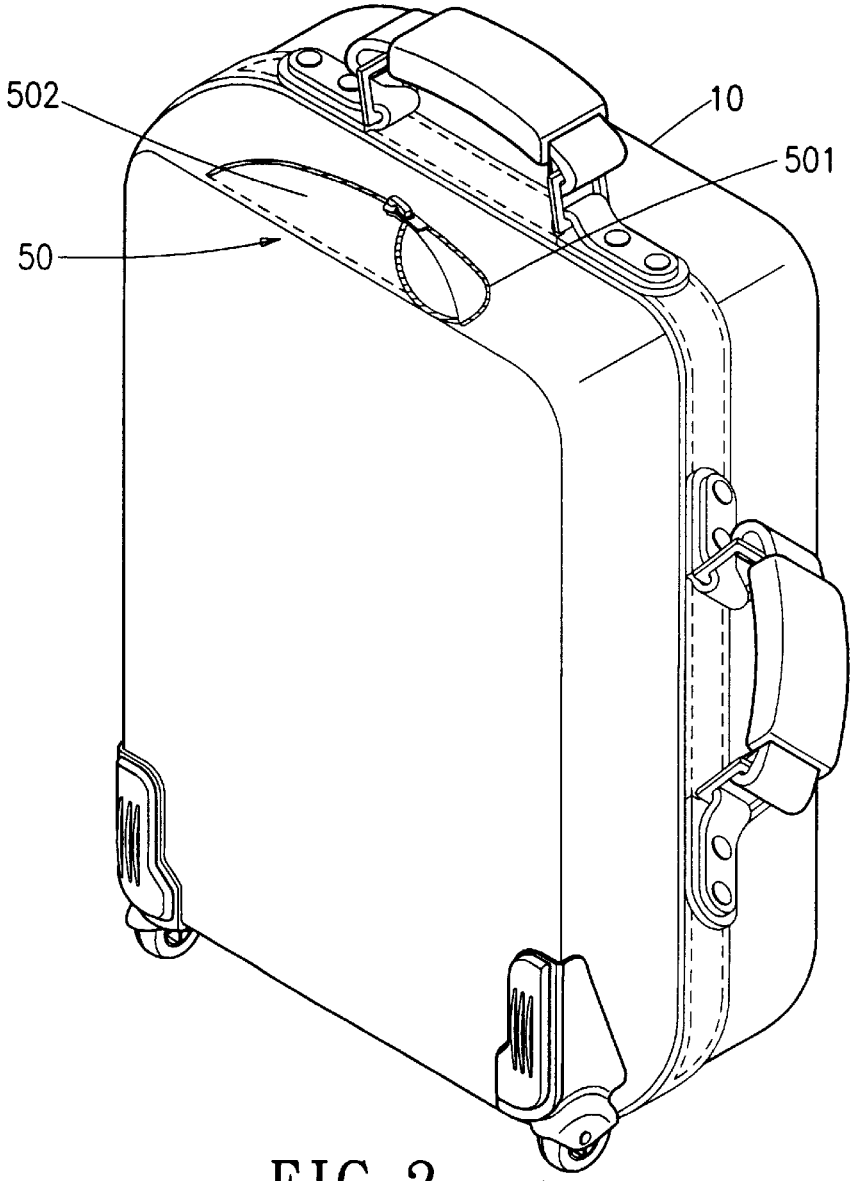
FIG. 2 is a perspective view of a wheeled luggage with hidden handle assembly constructed according to the present invention.

Referring to FIGS. 2–5A, there is shown a wheeled luggage comprising a body 10, a pair of wheels (not specifically shown), a frame member 11 having a number of third holes 13, a backing plate 20 having a concave portion 21 and a number of first and fourth holes 22 and 23, a retractable handle 30, and a bezel 31 having a number of second holes 311.

Firstly, a number of fasteners 4 (four are shown) such as screws or rivets are employed to secure the backing plate 20 to the bezel 31 by passing through the first holes 22 and the second holes 311. Secondly, a pair of fasteners 4A such as screws or rivets are employed to secure the frame member 11 to the backing plate 20 by passing through the third holes 13 and the fourth holes 23. Finally, secure the body 10 shell to the above secured components in a manner known in the art to form a complete luggage structure.

The handle 30 may be retracted into the rod sleeves 33 in the stored position. Further, A closure 50 comprising a cover 502 and a zipper 501 is provided on the top surface of the body 10 for receiving the retracted handle 30 therein, thus providing a hidden configuration to the handle 30, the backing plate 20, and the bezel 31 for preserving luggage's appearance.

Note that the backing plate 20 may be made of hard thermoplastic material, and the frame member 11 may be made of corrugated plastics or metal.

Figure 3:
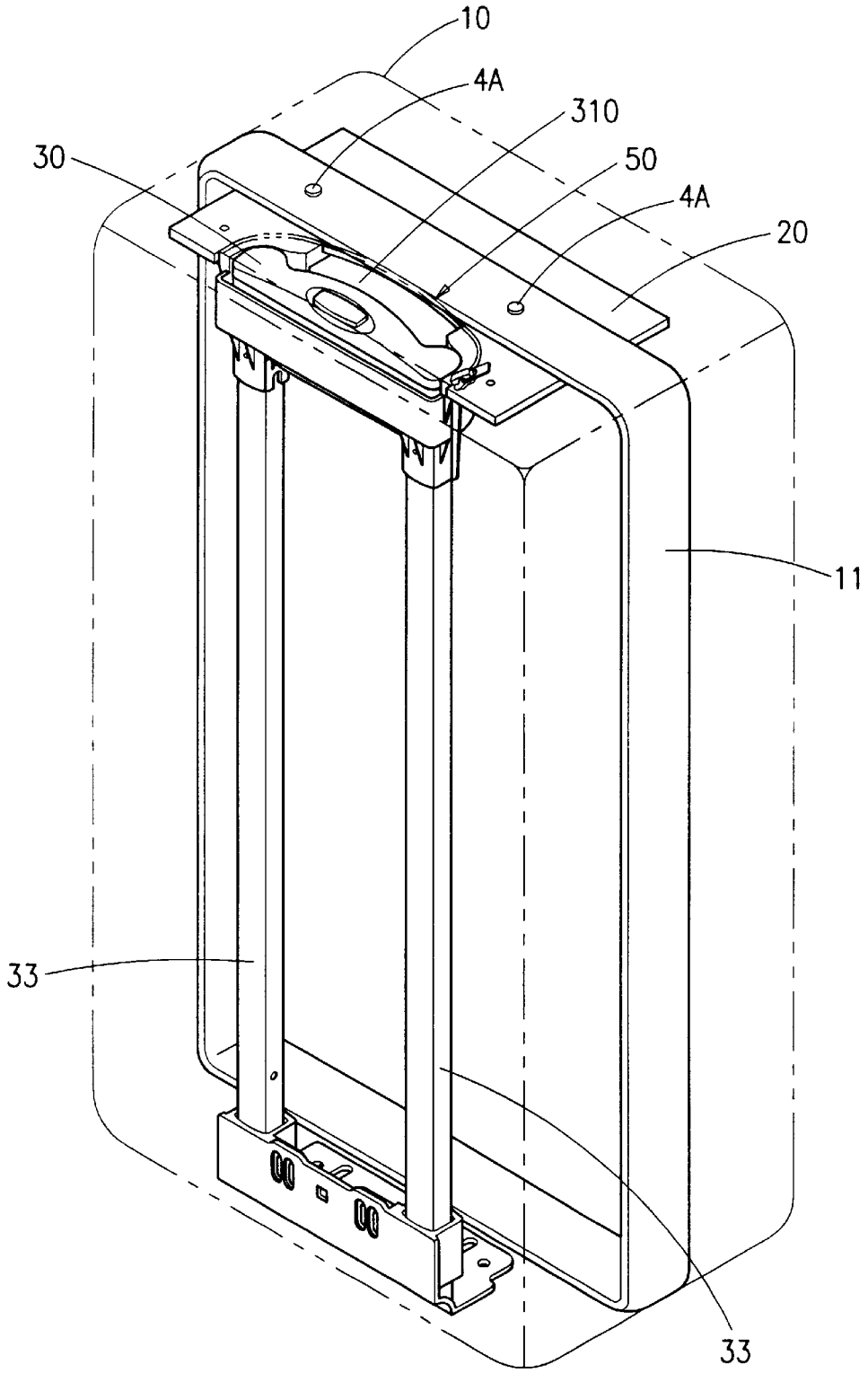
FIG. 3 is a perspective view of a wheeled luggage with hidden handle assembly of a first preferred embodiment of the present invention with the body shown in dash line.
Figure 4:
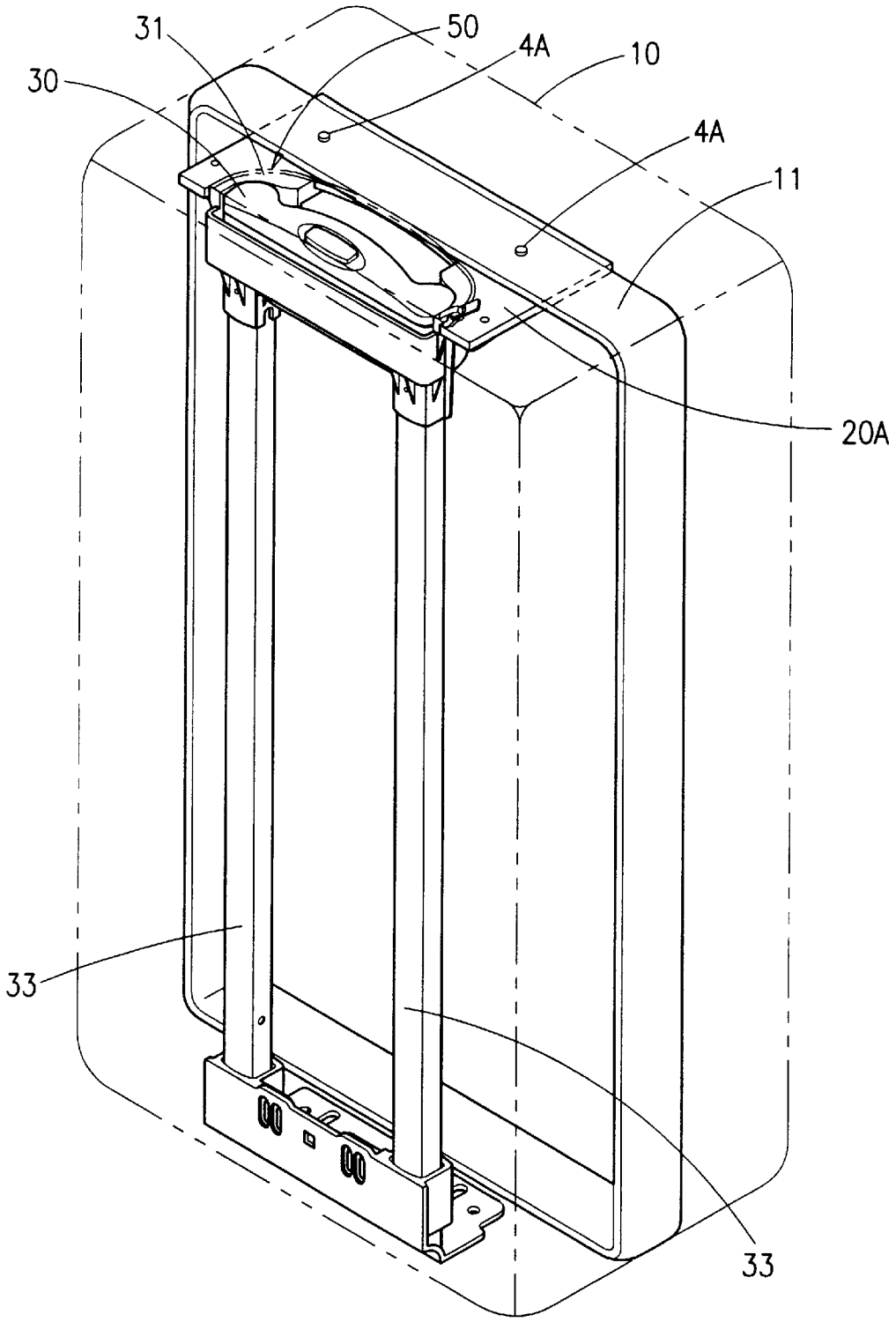
FIG. 4 is a perspective view of a wheeled luggage with hidden handle assembly of a second preferred embodiment of the present invention with the body shown in dash line.

The backing plate 20 may share the weight of the luggage. In addition, the backing plate 20 may be sized to accommodate different luggage capacities for saving material without sacrificing the strength. This configuration further allows a greater flexibility in an effort to reduce luggage weight. For example, the backing plate 20 in the embodiment of FIG. 3 is smaller than the backing plate 20 in the embodiment of FIG. 4.

Figure 5A:
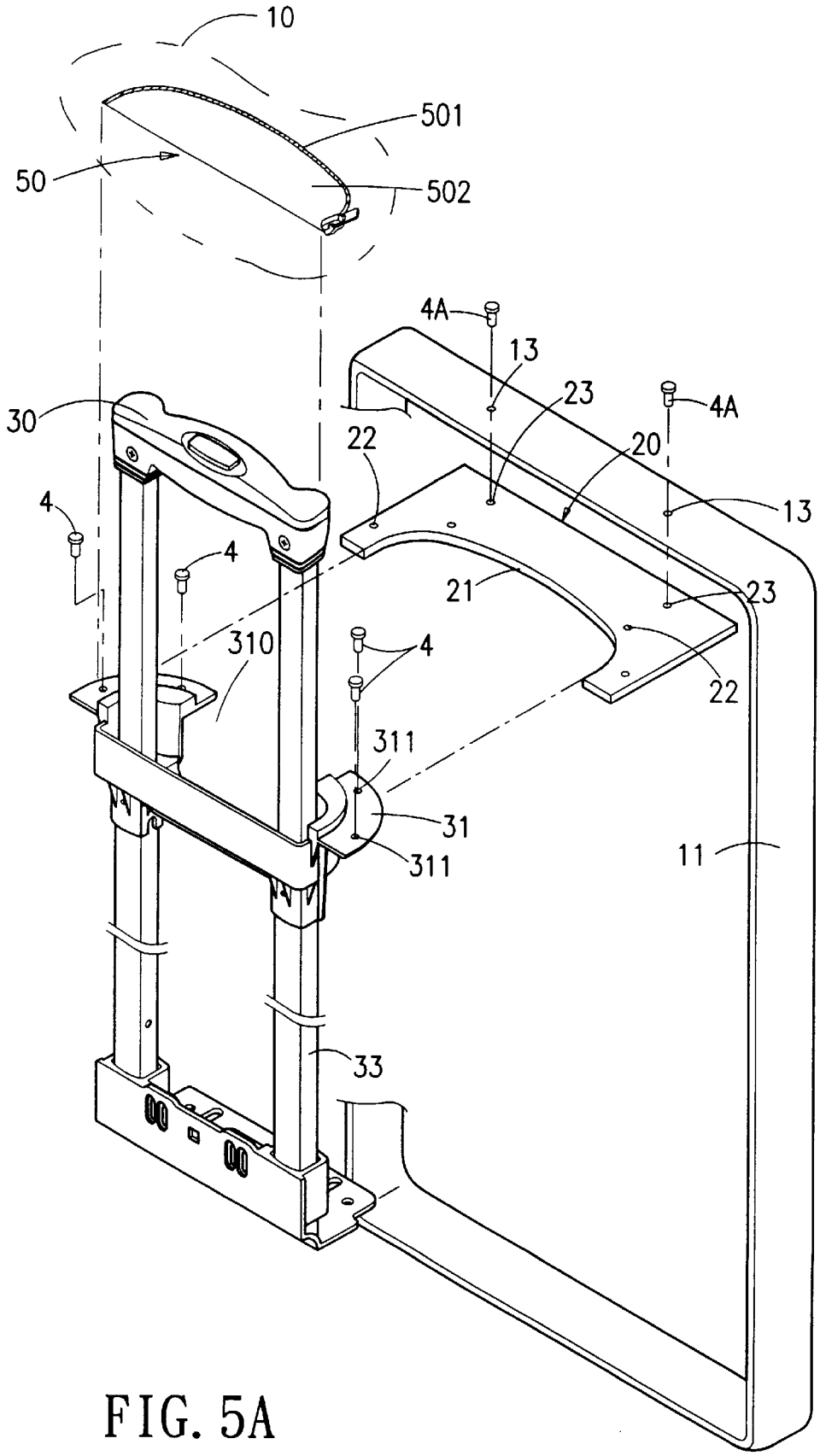
FIG. 5A is an exploded perspective view of the handle assembly, the bag with zipper fastener, the backing plate, and the frame member of the embodiment of FIG. 4.
Figure 5B:
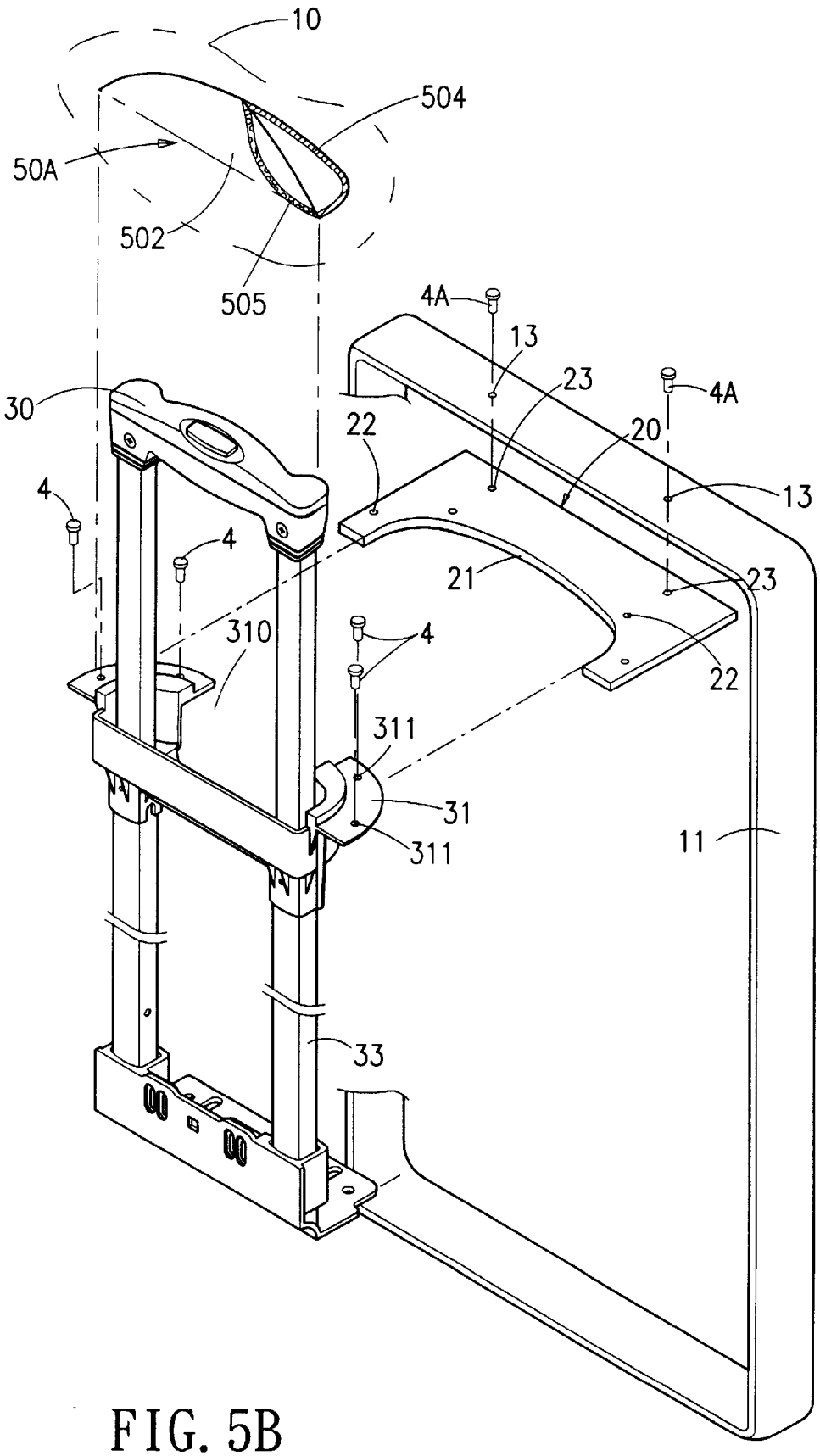
FIG. 5B is an exploded perspective view of the handle assembly, the bag with male and female releasably secured strap, the backing plate, and the frame member of the embodiment of FIG. 4.

Note that the zipper 501 may be replaced with a circumferential releasably secured means 50A in FIG. 5B. In detail, edge of the inner portion of bag 50 is provided with a narrow male releasably secured strip 504, while edge of the cover 502 is provided with a corresponding female releasably secured strip 505. The purpose of conveniently opening and closing the bag 50 is achieved by both configurations.

Figure 6:
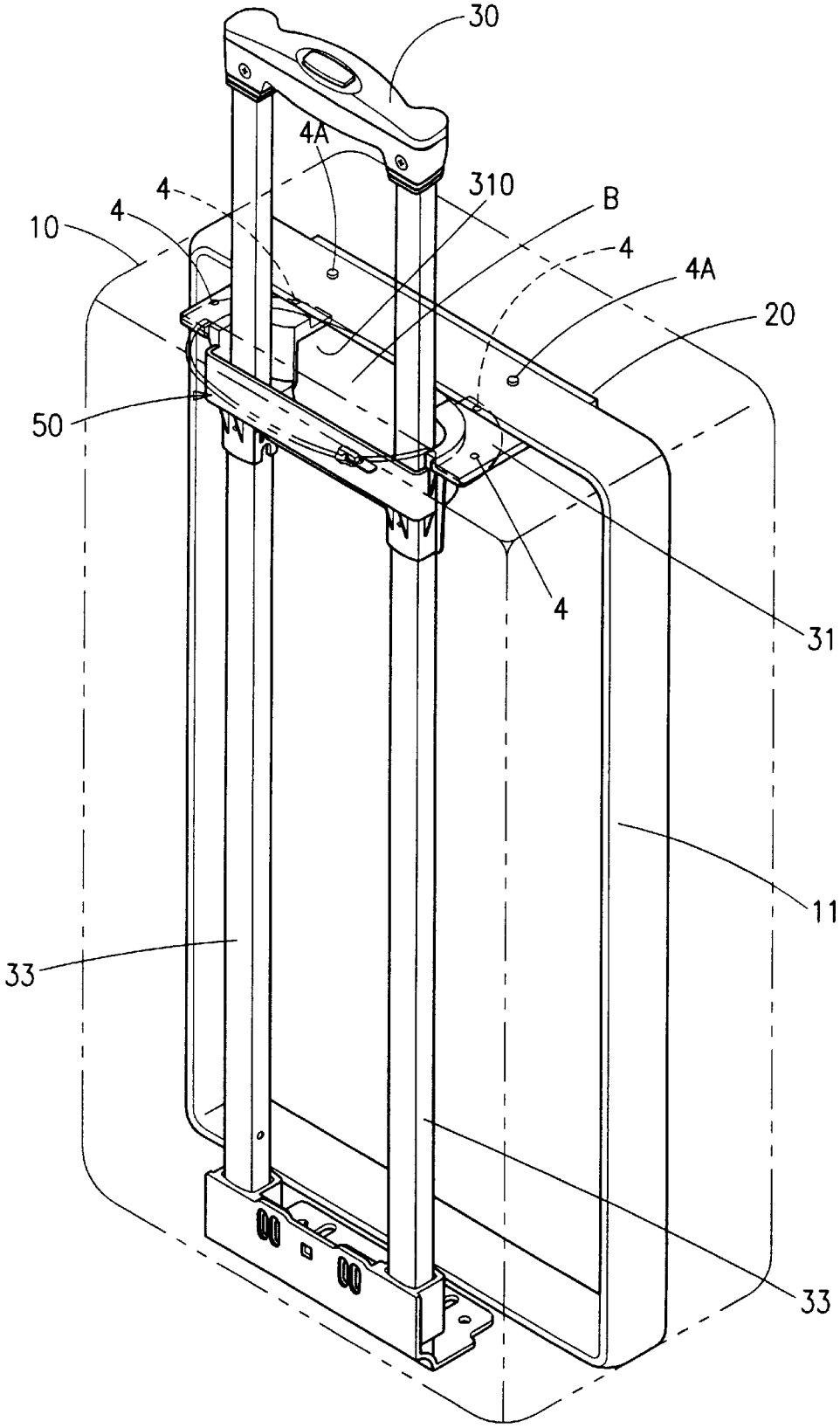
FIG. 6 is a schematic perspective view of a wheeled luggage with hidden handle assembly showing an extended handle.

Referring to FIGS. 5A, 5B, and 6 specifically, a first concave area 310 is formed between the backing plate 20 and the bezel 31 when they are secured together. Further, a second concave area B is formed between the first concave area 310 and the concave portion 21. The second concave area B accommodates user's fingers, thus facilitating to grasp the handle 30.

While the invention herein disclosed has been described by means of specific embodiments, numerous modifications and variations could be made thereto by those skilled in the art without departing from the scope of the invention set forth in the claims.

What is claimed is:

1. A wheeled luggage comprising a body having four sides and upper and lower ends, a substantially rectangular outer frame extending around said body in a first plane and a retractable handle extending along one side of said body in a second plane parallel to said first plane, and a pair of wheels with one of said wheels disposed in a corner of said lower end and the other of said wheels disposed in an opposite corner of said lower end, a backing plate having a concave portion disposed adjacent an upper end of said body between said body and said generally rectangular outer frame in a plane perpendicular to said first and second planes, a bazel having a split construction to form a concave portion, a plurality of first fasteners securing said backing plate to said bazel and a plurality of second fasteners securing said frame member to said body backing plate; said body being secured to said frame member to form a complete structure; a first concave area being formed between said backing plate and said bazel and a second concave area being formed between the first concave area and the concave portion of the backing plate for accommodating a users fingers and wherein a cover and a releasable securing means is disposed on said upper end of said body for enclosing the retractable handle within said body when said handle is in a retracted position.

2. The wheeled luggage of claim 1, wherein the releasably secured means is a circumferential zipper.

3. The wheeled luggage of claim 1, wherein the releasably secured means is a circumferential male and female releasably secured members.

* * * * *